US009395150B2

(12) United States Patent
Park

(10) Patent No.: US 9,395,150 B2
(45) Date of Patent: Jul. 19, 2016

(54) BENDABLE FIREARM HAVING OFF-AXIS SHOULDER REST AND SIGHT

(71) Applicant: Sang Weon Park, Seoul (KR)

(72) Inventor: Sang Weon Park, Seoul (KR)

( * ) Notice: Subject to any disclaimer, the term of this patent is extended or adjusted under 35 U.S.C. 154(b) by 0 days.

(21) Appl. No.: 14/771,497

(22) PCT Filed: Mar. 12, 2014

(86) PCT No.: PCT/KR2014/002071

§ 371 (c)(1),
(2) Date: Aug. 30, 2015

(87) PCT Pub. No.: WO2014/148766

PCT Pub. Date: Sep. 25, 2014

(65) Prior Publication Data

US 2016/0018184 A1 Jan. 21, 2016

(30) Foreign Application Priority Data

Mar. 19, 2013 (KR) ..... 10-2013-0029041

(51) Int. Cl.

| | |
|---|---|
| ***F41C 23/04*** | (2006.01) |
| ***F41C 23/14*** | (2006.01) |
| ***F41C 23/20*** | (2006.01) |
| ***F41G 1/38*** | (2006.01) |
| ***F41G 1/40*** | (2006.01) |

(52) U.S. Cl.

CPC ..... *F41C 23/14* (2013.01); *F41C 23/04* (2013.01); *F41C 23/20* (2013.01); *F41G 1/38* (2013.01); *F41G 1/40* (2013.01)

(58) Field of Classification Search

CPC ..... F41C 23/14; F41C 23/04; F41C 23/20; F41G 1/38; F41G 1/40

USPC ..... 42/73, 72, 71.01, 118, 69.01

See application file for complete search history.

(56) References Cited

U.S. PATENT DOCUMENTS

| | | | | |
|---|---|---|---|---|
| 694,904 | A * | 3/1902 | Youlten | F41G 1/40 356/254 |
| 755,773 | A * | 3/1904 | Hoerr | F41C 27/16 30/315 |
| 762,862 | A * | 6/1904 | Phillips | F41C 23/12 224/577 |
| 813,932 | A * | 2/1906 | Youlten | F41G 1/30 356/254 |
| 1,084,848 | A * | 1/1914 | Demele | F41C 23/04 359/416 |

(Continued)

FOREIGN PATENT DOCUMENTS

JP 2007-118257 5/2007

OTHER PUBLICATIONS

English abstract of 2007-118257.

*Primary Examiner* — Joshua Freeman

(74) *Attorney, Agent, or Firm* — Antonio Ha & U.S. Patent, LLC

(57) ABSTRACT

The present invention relates to a bendable firearm having an off-axis shoulder rest and a sight, which enables stable aiming and firing since a shoulder rest is bent in an off-axis shape and provides a new structure having excellent stability by minimizing exposure of the body. The bendable firearm having the off-axis shoulder rest and the sight, according to the present invention, comprising a firearm body (100) having a gun barrel (110) and a trigger unit (120) for firing a bullet through the gun barrel (110); a shoulder rest (200) provided at a rear end of the firearm body (100); and a sight (300) which is coupled with the firearm body (100), wherein the shoulder rest (200) is coupled so as to be bendable from the firearm (100) by an additional shoulder rest adapter (400).

12 Claims, 17 Drawing Sheets

(56) References Cited

U.S. PATENT DOCUMENTS 1,174,282 A * 3/1916 Richard ..... F41G 1/40 356/254
1,176,893 A * 3/1916 Hartney ..... F41G 1/30 126/299 R
1,184,078 A * 5/1916 Cooke ..... F41G 1/40 42/118
1,195,055 A * 8/1916 McNeal ..... F41G 1/40 42/118
1,196,822 A * 9/1916 Sues ..... F41C 23/14 42/73
1,248,029 A * 11/1917 Mantha et al. ..... F41C 23/14 42/73
1,260,285 A * 3/1918 Cordell ..... F41G 1/40 356/254
1,264,133 A * 4/1918 Morris ..... F41G 1/06 42/118
1,269,178 A * 6/1918 Hamilton ..... F41G 1/40 356/254
1,300,688 A * 4/1919 Bellard ..... F41G 1/40 42/118
2,400,349 A * 5/1946 Haberstump ..... F41C 23/04 42/72
2,427,593 A * 9/1947 Etzel, Jr. ..... F16M 13/04 224/0.5
2,441,487 A * 5/1948 Howard ..... F41C 23/04 42/72
2,627,132 A * 2/1953 Dolgacius ..... F41G 1/40 356/254
3,256,632 A * 6/1966 Beretta ..... F41C 23/00 42/72
3,262,440 A * 7/1966 Kuhn ..... F41B 11/51 124/53
3,618,249 A * 11/1971 Grandy ..... F41C 23/04 42/72
3,798,819 A * 3/1974 Hillberg ..... F41C 23/04 42/71.01
4,878,305 A * 11/1989 Gabrielidis ..... F41G 1/41 42/118
D398,035 S * 9/1998 Rowe ..... D22/100
6,311,424 B1 * 11/2001 Burke ..... F41G 1/40 42/111
6,543,173 B1 * 4/2003 Golan ..... F41A 19/09 42/75.04
6,591,533 B2 * 7/2003 Wygant ..... F41C 23/04 16/327
6,598,329 B1 * 7/2003 Alexander ..... F41C 23/04 42/114
6,901,691 B1 6/2005 Little
7,065,914 B1 * 6/2006 Wagner, II ..... F41C 23/04 124/74
7,137,220 B1 * 11/2006 Bradley, Jr. ..... F41G 1/40 356/254
7,437,847 B1 * 10/2008 Mabry ..... F41C 23/04 42/71.02
7,552,557 B1 * 6/2009 Mabry ..... F41A 11/04 42/71.01
7,640,691 B2 * 1/2010 Karcher ..... F41G 1/40 359/399
D664,606 S * 7/2012 Johnson ..... D21/573
8,312,661 B2 * 11/2012 Ludlow ..... F41C 23/04 42/73
8,769,855 B2 * 7/2014 Law ..... F41C 23/14 42/73
9,015,980 B2 * 4/2015 Shull ..... F41C 23/04 42/72
2005/0115140 A1 * 6/2005 Little ..... F41A 23/02 42/118
2005/0132631 A1 * 6/2005 Bodo ..... F41G 1/40 42/118
2006/0196098 A1 * 9/2006 Lee ..... F41G 1/38 42/123
2008/0000132 A1 * 1/2008 Orvis ..... F41C 23/00 42/73
2012/0030984 A1 * 2/2012 Andersson ..... F41C 23/12 42/75.03
2012/0151813 A1 * 6/2012 Brown ..... F41C 7/00 42/73
2013/0036645 A1 * 2/2013 Chvala ..... F41C 23/04 42/73
2014/0196344 A1 * 7/2014 Malik ..... F41C 23/04 42/73
2015/0013203 A1 * 1/2015 Lopiccolo ..... F41C 23/04 42/73
2016/0018184 A1 * 1/2016 Park ..... F41C 23/14 42/73

* cited by examiner

BENDABLE FIREARM HAVING OFF-AXIS SHOULDER REST AND SIGHT

TECHNICAL FIELD

The present invention relates to a bendable firearm having an off-axis shoulder rest and sight and, more particularly, to a bendable firearm having an off-axis shoulder rest and sight, which enables stable aiming and firing because the shoulder rest is bent in an off-axis shape and provides a new structure having excellent stability by minimizing exposure of a user's body.

BACKGROUND ART

A swivelable firearm, which is called Corner Shot, is provided to enable a user to chase and monitor a target in a state in which the user hides himself using a shelter and to take an aimed shot at the target as needed. As shown in FIG. 1, this swivelable firearm is configured such that a shoulder rest is swiveled relative to a gun barrel in an L shape.

Therefore, since recoil generated from the conventional swivelable firearm in the event of firing is turned and transmitted halfway, the recoil is different from that transmitted directly backward in a typical firearm. In this way, since the recoil of the swivelable firearm is different from that of the typical firearm, the swivelable firearm hardly ensures stable aiming and firing.

Further, it is difficult to stably hold the shoulder rest against a shoulder of the user. Thus, the user supports the shoulder rest with an upper muscle part of an arm grasping the firearm or grasps the firearm with both hands, and should absorb impacts generated in the event of the firing. As a result, lasting stable aiming and firing are more difficult.

For this reason, the conventional swivelable firearm is restrictively used only for small firearms such as pistols having relatively small recoil.

Meanwhile, a simple aiming device such as an angle sight or an off-axis viewing device that enables aiming at 90 or 45 degrees is also added to the typical firearm. However, these aiming devices require much time to aim at a target due to a phenomenon of left-right reflection (reversal) of light. Especially, it is not an exaggeration to say that it is nearly impossible to aim and fire at a moving target.

Further, the user can hide behind a shelter to aim and fire at the target. However, there is a drawback that the hand grasping the firearm and the am region are inevitably exposed and that the impacts generated in the event of the firing are not properly controlled.

With regard to this problem, an image acquisition device such as a camera, or a display device such as a monitor is also connected to the firearm when used. However, these devices are expensive, and it is difficult to distribute them to all soldiers. Further, for correct use, special training as well as a power supply is required. There is a drawback that a considerable cost and time are required for management and maintenance of the devices.

(Patent Document 1) Published Korean Translation No. 1988-7000235 (1988, 02, 20) of the PCT Intentional Publication

DISCLOSURE

Technical Problem

Accordingly, the present invention has been made in an effort to solve the problems occurring in the related art, and an object of the present invention is to provide a new bendable firearm having an off-axis shoulder rest and sight, in which, as an off-axis aiming and fire mode is employed instead of a L-shaped aiming and fire mode of a conventional swivelable firearm, recoil generated when fired is transmitted directly backward from a gun barrel, control over the recoil is possible, and correct holding of the shoulder rest is possible to lead to stable firing, and in which, as a periscope type sight is used, stable aiming is easy, exposure of a user's body is minimized to provide excellent safety.

Technical Solution

According to one aspect of the present invention, there is provided a bendable firearm having an off-axis shoulder rest and sight, which includes: a firearm body (100) having a gun barrel (110) and a percussion mechanism (120) for firing a ball cartridge though the gun barrel (110); a shoulder rest (200) provided at a rear end of the firearm body (100); and a sight (300) coupled to the firearm body (100). The shoulder rest (200) is bendably coupled to the firearm body (100) by a separate shoulder rest adapter (400).

Further, the shoulder rest adaptor (400) includes a first adaptor (420), a front end of which is directly or indirectly rotatably connected to the firearm body (100) and at a rear end of which, a connecting bar (422) is formed to protrude to one side, and a second adaptor (440), a front end of which is detachably coupled to the connecting bar (422) of the first adaptor (420) and a rear end of which is directly or indirectly rotatably connected to the shoulder rest (200).

Also, the fast adaptor (420) is rotatably coupled to a rear end of a first auxiliary adaptor (410) screwed into the firearm body (100) so as to be connected to the firearm body (100) by the first auxiliary adaptor (410), and an angle adjusting means for adjusting an rotational angle of the first adaptor (420) is provided between the first adaptor (420) and the first auxiliary adaptor (410).

Further, a plurality of pin holes (421) are formed in the connecting bar (422) in a longitudinal direction; an insertion recess (442) into which the connecting bar (422) is inserted in a width direction and a pair of upper and lower pin holes (443) crossing the insertion recess (442) are formed at the front end of the second adaptor (440); and the second adaptor (440) and the connecting bar (422) are detachably coupled by fixing pins (449) inserted into the aligned pin holes (421, 443) of the connecting bar (422) and the second adaptor (440).

Further, the sight (300) includes: a base (310) that is detachably coupled to the firearm body (100); a main body tube (320) that is coupled to the base (310); a T-shaped connector (330) that is formed with a branch tube (331), has a T shape, and is coupled to the main body tube (320); and an auxiliary body tube (340) that has an elbow shape and is coupled to the branch tube (331) of the T-shaped connector (330).

Further, the main body tube (320) is pivotably coupled to the base (310), the T-shaped connector (330) is rotatably coupled to the main body tube (320), and angle adjusting means for adjusting pivotal and rotational angles are provided between the main body tube (320) and the base (310) and between the main body tube (320) and the T-shaped connector (330).

Also, a prism (332) for reflecting incident light to the branch tube (331) of the T-shaped connector (330) at an angle of 90 degrees so as to travel straight is mounted in the main body tube (320), and a reflector (342) for reflecting the incident light to the rear at an angle of 90 degrees again is mounted in an elbow region of the auxiliary body tube (340).

Further, the branch tube (331) or an end connected to the branch tube (331) of the auxiliary body tube (340) is telescopically formed to be able to adjust a distance between the auxiliary body tube (340) and the main body tube (320).

Further, the bendable firearm further includes an auxiliary percussion device (500), which includes an auxiliary percussion body (510), a rear end of which is coupled to the second adaptor (440); an auxiliary trigger (520) that is mounted on the auxiliary percussion body (510); an auxiliary grip (530) that is mounted on the auxiliary percussion body (510) so as to be located back of the auxiliary trigger (520); a connecting cable (540), one end of which is connected to the auxiliary trigger (520) and the other end of which is connected to a trigger (122) provided for the percussion mechanism (200) of the firearm body (100); and a return spring (560) that is coupled to the connecting cable (540) and returns the auxiliary trigger (520) to a state before operation, and when the auxiliary trigger (520) is operated, the trigger (122) of the percussion mechanism (120) is operated together with the auxiliary trigger (520) such that a ball cartridge is fired by the percussion mechanism (120).

Further, the connecting cable (540) is inserted in a cable case (550).

Further, slide holes (458) penetrated in a forward/backward direction are formed at a lower side of the second auxiliary adaptor (450), and a rear end of the auxiliary percussion body (510) is slidably fitted into the slide holes (458) so as to be able to adjust a front/rear position of the auxiliary percussion device (500).

In addition, an upper end of the auxiliary grip (530) is pivotably coupled to the auxiliary percussion body (510).

Advantageous Effects

The present invention having this configuration can aim and fire at a target without exposing a user's body under a shelter, and thus reduce a fear of being shot Damage caused in combat is reduced to increase a survival rate as the exposure of the human body is reduced, and a loss of fighting capacity is reduced.

Moreover, when the auxiliary percussion device (500) is mounted for use, exposure of hands and arms grasping the firearm can be avoided, and thus the loss of fighting capacity can be further reduced.

Especially, since the shoulder rest (200) is bent but always assumes an off-axis shape parallel with the gun barrel (110), recoil is generated directly back of the shoulder rest (200) unlike a conventional bendable firearm. In this way, since the recoil is generated in the same direction as an ordinary firearm, control over the recoil is easy.

In addition, since the control over the recoil is easy, the present invention can be applied to a large firearm, let alone a small firearm such as a pistol. Since a user can correctly hold the shoulder rest (200) is correctly stably held against a user's shoulder in the event of firing, there is an advantage that stable firing is possible.

Meanwhile, in the sight (300) according to the present invention, eyepieces (321, 341) of the main and auxiliary body tubes (320, 340) are located in parallel toward the shoulder rest (200). Therefore, unlike a conventional sight, the aiming is easy because no left-right reflection (reversal) of light occurs. Further, there is an advantage that a single sight can be used in various fire modes.

The present invention having this configuration is simple in structure, small in fear of a failure, and easy in operation, and has an advantage that a separate device or training is not required.

In addition, the shoulder rest adaptor (400), the sight (300), and/or the auxiliary percussion device (500) according to the present invention can be applied to the conventional firearm. Thus, without newly manufacturing the entire firearm, the present invention can be carried out using the conventional firearm, and thus is economical.

MODE FOR INVENTION

Hereinafter, the present invention will be described in detail with reference to the attached drawings.

The present invention is directed to a bendable firearm configured to enable aiming and firing in a state in which a user hides himself using a shelter. The term "firearm" used herein refers to all types of firearms such as a grenade launcher and a rocket launcher, including a sniper rile. The term "shoulder rest" refers to all types of shoulder rests such as a foldable shoulder rest and a telescopic shoulder rest, let alone a fixed shoulder rest.

Especially, the term "off-axis" used herein means that a central axis of a shoulder rest or a sight is located at one side in parallel to a reference axis, i.e. a central axis of a gun barrel.

In the present embodiment, an example in which the present invention is applied to a personal rifle for a foot soldier will be described.

Figure 1:
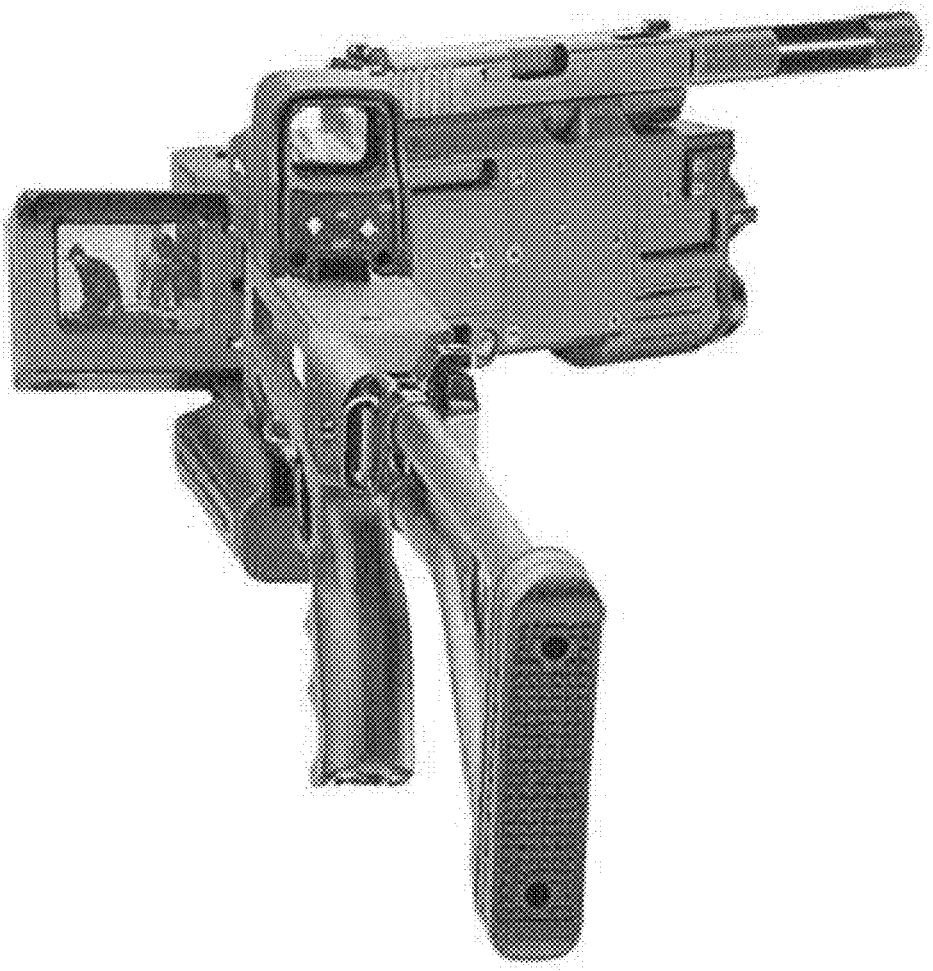
Fig. 1 Prior Art
FIG. 1 is a view showing a conventional Corner Shot.
Figure 2:
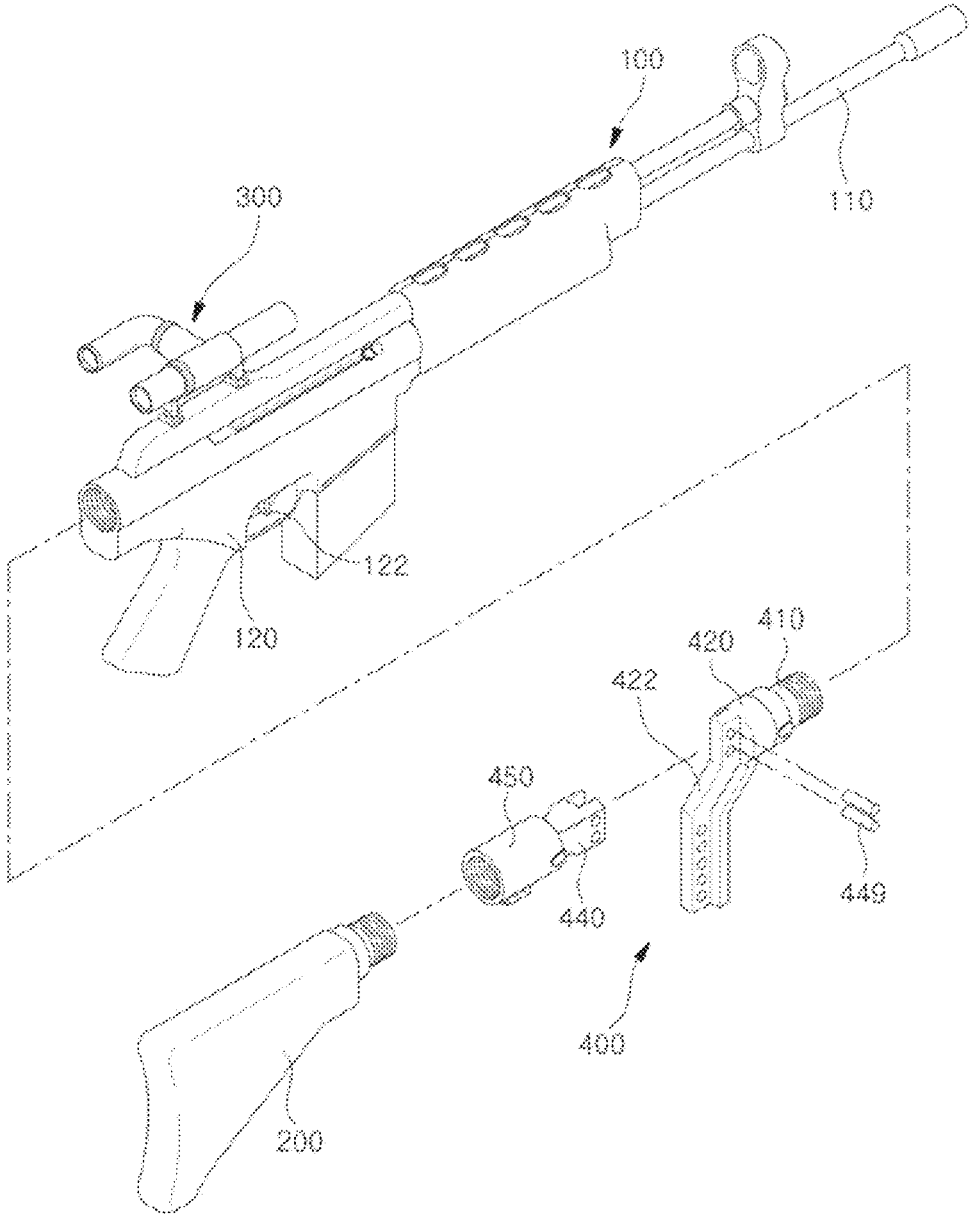
FIG. 2 is an exploded perspective view of a firearm according to an embodiment of the present invention.
Figure 3:
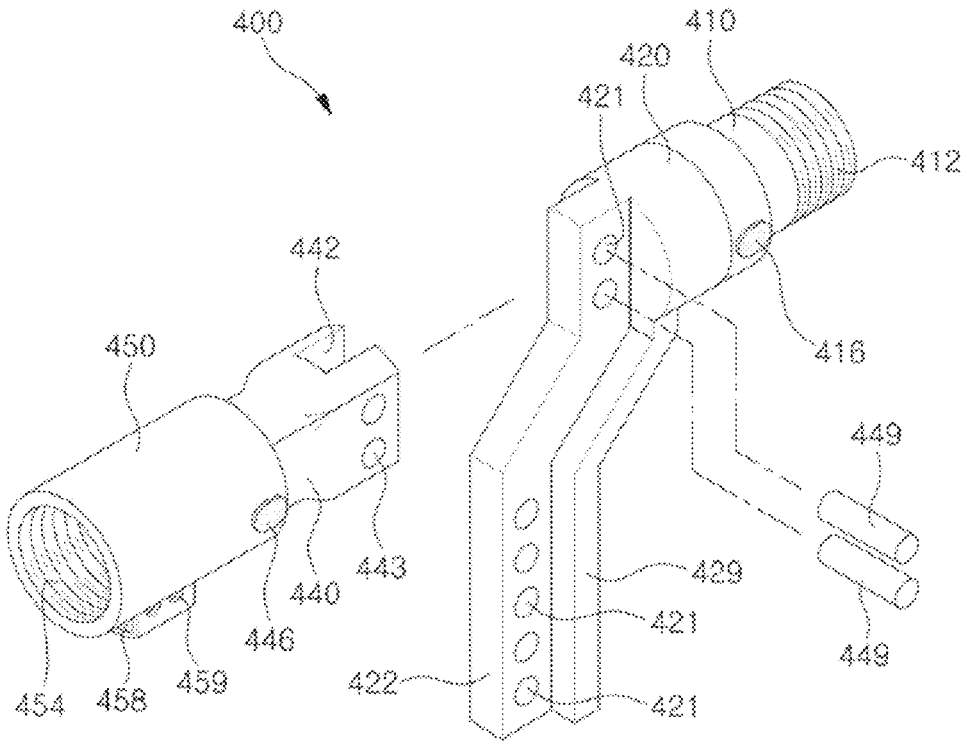
FIG. 3 is an exploded perspective view enlarging and showing a shoulder rest adaptor of the firearm shown in FIG. 2.

Referring to FIG. 2, the present invention includes a firearm body 100 having a gun barrel 110 and a percussion mechanism 120, a shoulder rest 200 coupled to a rear end of the firearm body 100, and a sight 300 coupled to the firearm body 100. The shoulder rest 200 is coupled to the firearm body 100 by a shoulder rest adaptor 400.

The shoulder rest adaptor 400 is made up of a first adaptor 420 that is connected to the firearm body 100, and a second adaptor 440 that is connected to the shoulder rest 200, which is called a stock, and is detachably coupled to the first adaptor 420.

The shoulder rest adapter 400 will be described below in greater detail with reference to FIGS. 3 to 6.

The first adaptor 420 is connected to the firearm body 100 by the first auxiliary adaptor 410 connected to the firearm body 100.

The first auxiliary adaptor 410 is formed with a thread 412 at a front end thereof, and is screwed into the firearm body 100. The first auxiliary adaptor 410 is formed with a coupling hole 414 to which the first adaptor 420 is rotatably coupled in a rear end thereof.

The first adaptor 420 is pivotably coupled to the coupling hole 414 at a front end thereof, and is formed with a connecting bar 422 to which the second adaptor 440 is coupled at a rear end thereof.

As shown, the connecting bar 422 protrudes to one side so as to have a long shape in a downward/upward direction. The connecting bar 422 is formed with a plurality of pin holes 421 that pass therethrough in a width direction.

Figure 4:
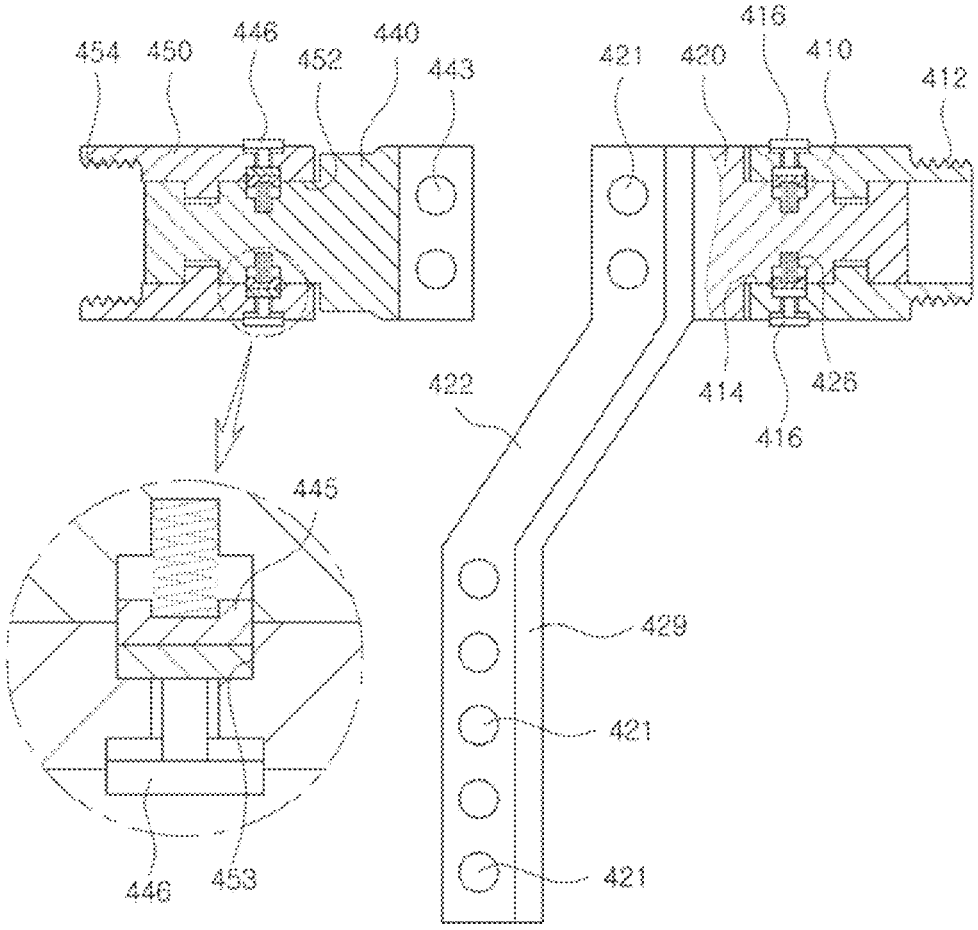
FIG. 4 is a side sectional view of the shoulder rest adaptor shown in FIG. 3.
Figure 5:
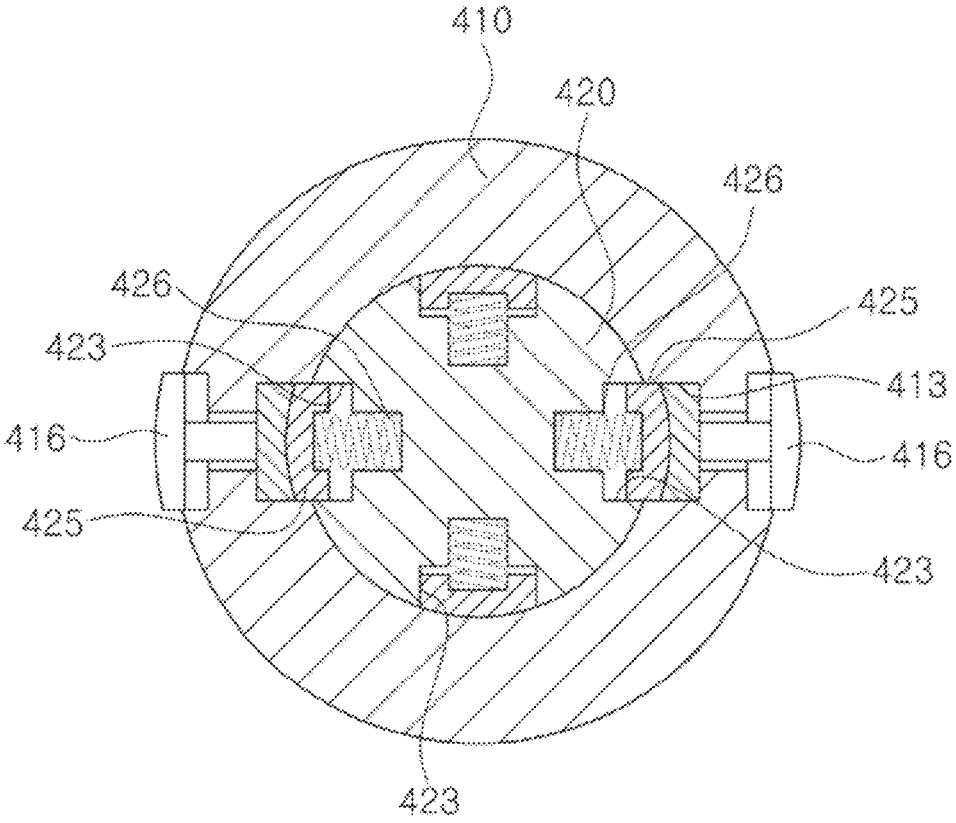
FIGS. 5 and 6 are longitudinal sectional views showing an operation of an angle adjusting mans of the shoulder rest adaptor shown in FIG. 3.
Figure 6:
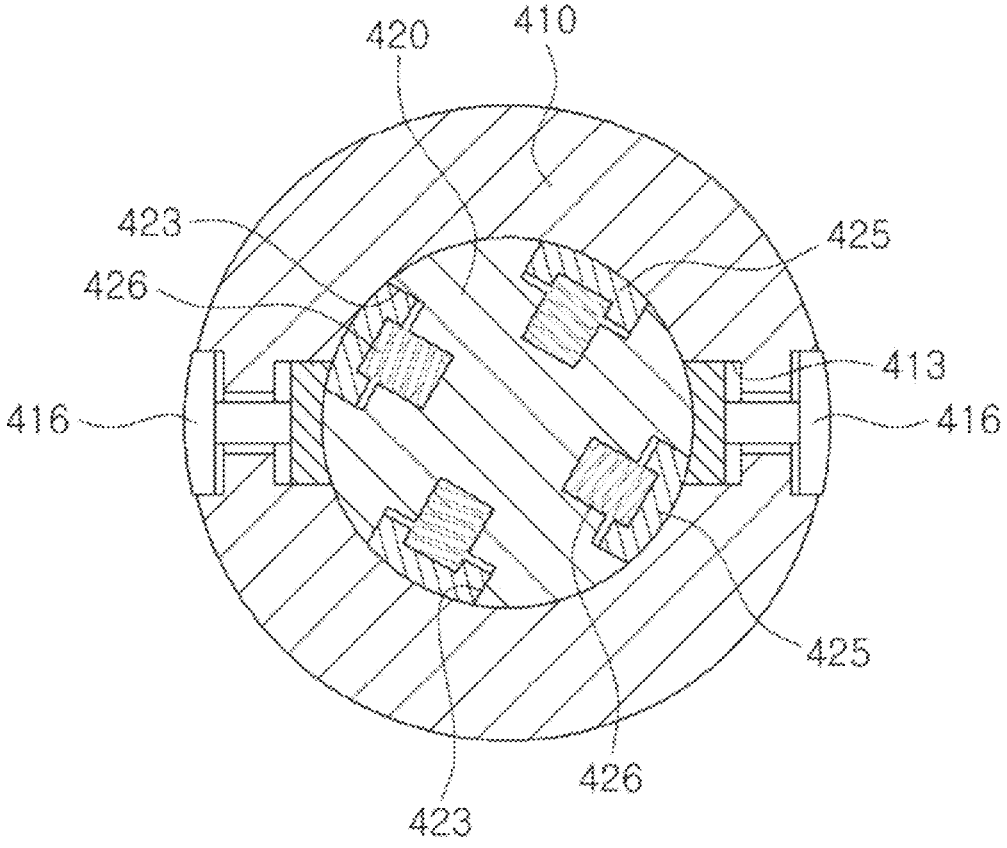

Meanwhile, an angle adjusting means for adjusting an angle of rotation of the first adaptor 420 is provided between the first auxiliary adaptor 410 and the first adaptor 420. As shown in FIGS. 4 to 6, the angle adjusting means is made up of stoppers 425 that are installed in installation recesses 423 formed in an outer circumferential surface of the first adaptor 420 at regular intvals, latch recesses 413 which are formed in an inner circumferential surface of the first auxiliary adaptor 410 and into which the stoppers 425 are inserted, and buttons 416 that are mounted in an outer circumferential surface of the first auxiliary adaptor 410 and separate the stoppers 425 inserted into the latch recesses 413 from the latch recesses 413.

Therefore, by rotating the first adaptor 420, the stoppers 425 aligned with the latch recesses 413 are inserted into the latch recesses 413. In this way, the rotation of the first adaptor 420 is controlled. When the stopers 425 are separated from the latch recesses 413 by the buttons 416, the first adaptor 420 is routable.

In the present embodiment, it is shown that the stoppers 425 are installed in the installation recesses 423 so as to be elastically biased outward by separate springs 426. If necessary, the stoppers 425 may be configured to be formed of leaf springs such that tips of the stoppers are inserted into the latch recesses 413 by elastic forces of the stoppers themselves.

In this case, when the fist adaptor 420 is rotated, the stoppers formed of leaf springs can be elastically deformed and separated from the latch recesses 413, and thus the separate buttons need not be provided. Further, if necessary, the stoppers may be formed of latch balls that are elastically biased outward by the springs.

Meanwhile, the second adaptor 440 is connected to the shoulder rest 200 by a second auxiliary adaptor 450. A front end of the second adaptor 440 is formed with an insertion recess 442 into which the connecting bar 422 is inserted in the width direction, and a pair of pin holes 443 that are formed across the insertion recess 442.

A front end of the second auxiliary adaptor 450 is formed with a coupling hole 452 into which the second adaptor 440 is routable inserted and coupled. Therefore, the second adaptor 440 and the second auxiliary adaptor 450 are rotatably coupled. A rear end of the second auxiliary adaptor 450 is formed with a thread 454, and the second auxiliary adaptor 450 is screwed onto the shoulder rest 200.

Meanwhile, an angle adjusting means is provided between the second adaptor 440 and the second auxiliary adaptor 450. The angle adjusting means is made up of stoppers 445, latch recesses 453, buttons 446, and so on, and has the same configuration as the angle adjusting means of the first adaptor 420.

The first adaptor 420 and the second adaptor 440 having these configurations are coupled by fixing pins 449 that are inserted into the pin holes 421 formed in the connecting bar 422 and the pin holes 443 formed in the second adaptor 440. At this time, according to a form of the shelter, a position at which the second adaptor 440 is coupled to the connecting bar 422 is adjusted.

Preferably, latch steps 429 are formed to protrude at opposite sides of the connecting bar 422. When the second adaptor 440 is coupled to the connecting bar 422, the latch steps 429 are intended to further facilitate aligning the pin holes 421 and 443, and the connecting bar 422 is reinforced by the latch steps 429.

Figure 7:
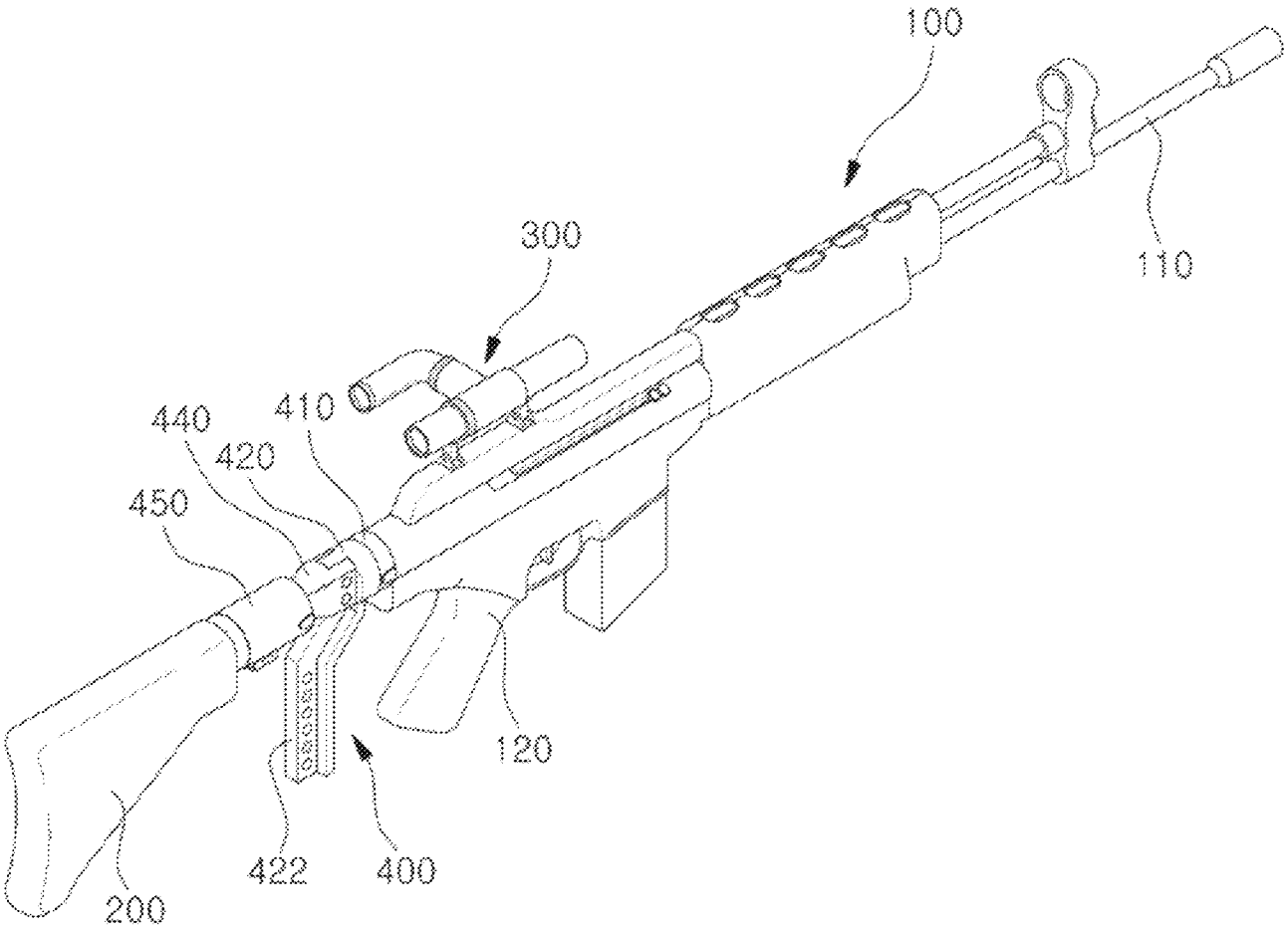
FIG. 7 is a perspective view showing an ordinary fire mode of the firearm shown in FIG. 2.

FIG. 7 shows an ordinary fire mode in which the second adaptor 440 coupled to the shoulder rest 200 is coupled to an upper end of the connecting bar 422 formed at the first adaptor 420.

Figure 8:
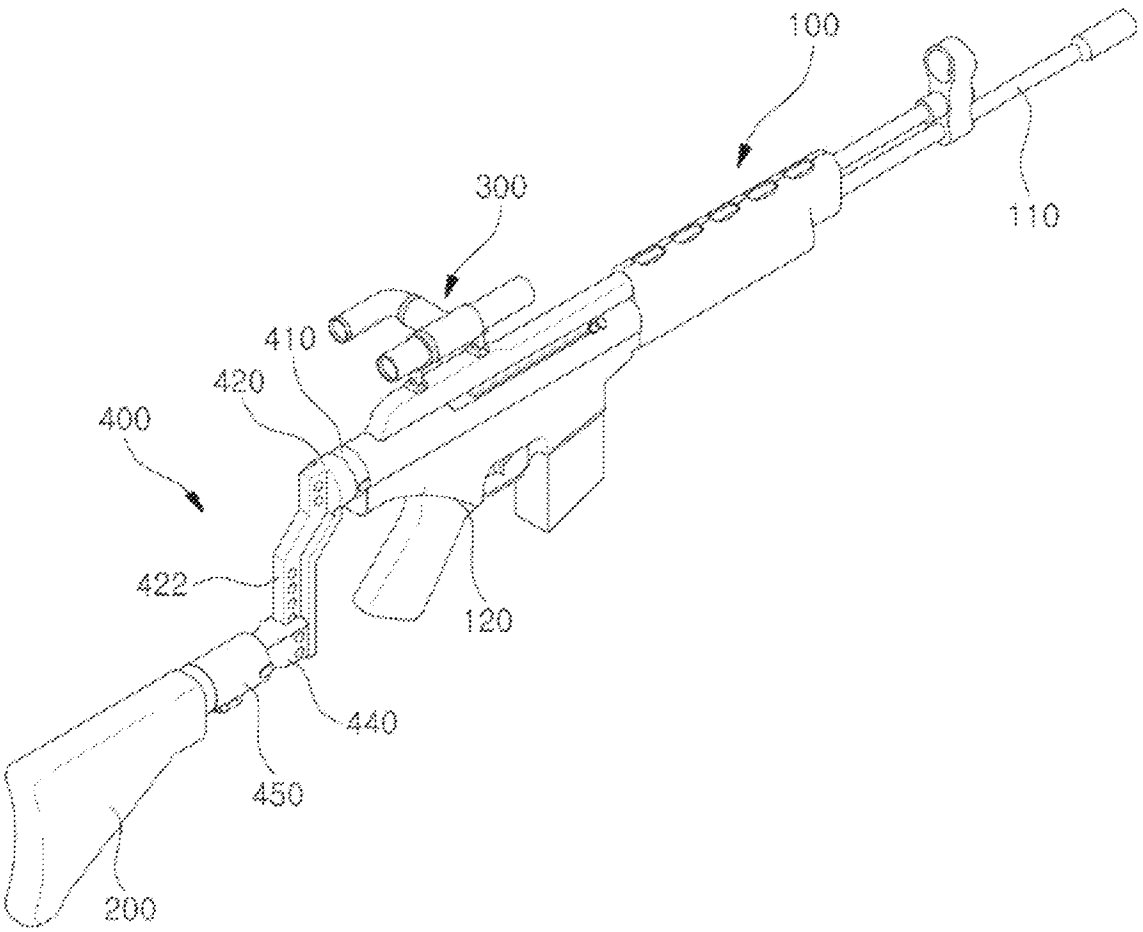
FIG. 8 is a perspective view showing an upper fire mode of the firearm shown in FIG. 2.

FIG. 8 shows a mode in which the user hides himself at a lower side of the shelter and fires at the target, i.e. an upper fire mode in which the second adaptor 440 is coupled to a lower end of the connecting bar 422 and the shoulder rest 200 is located below the firearm body 100 in a bent state.

Figure 9:
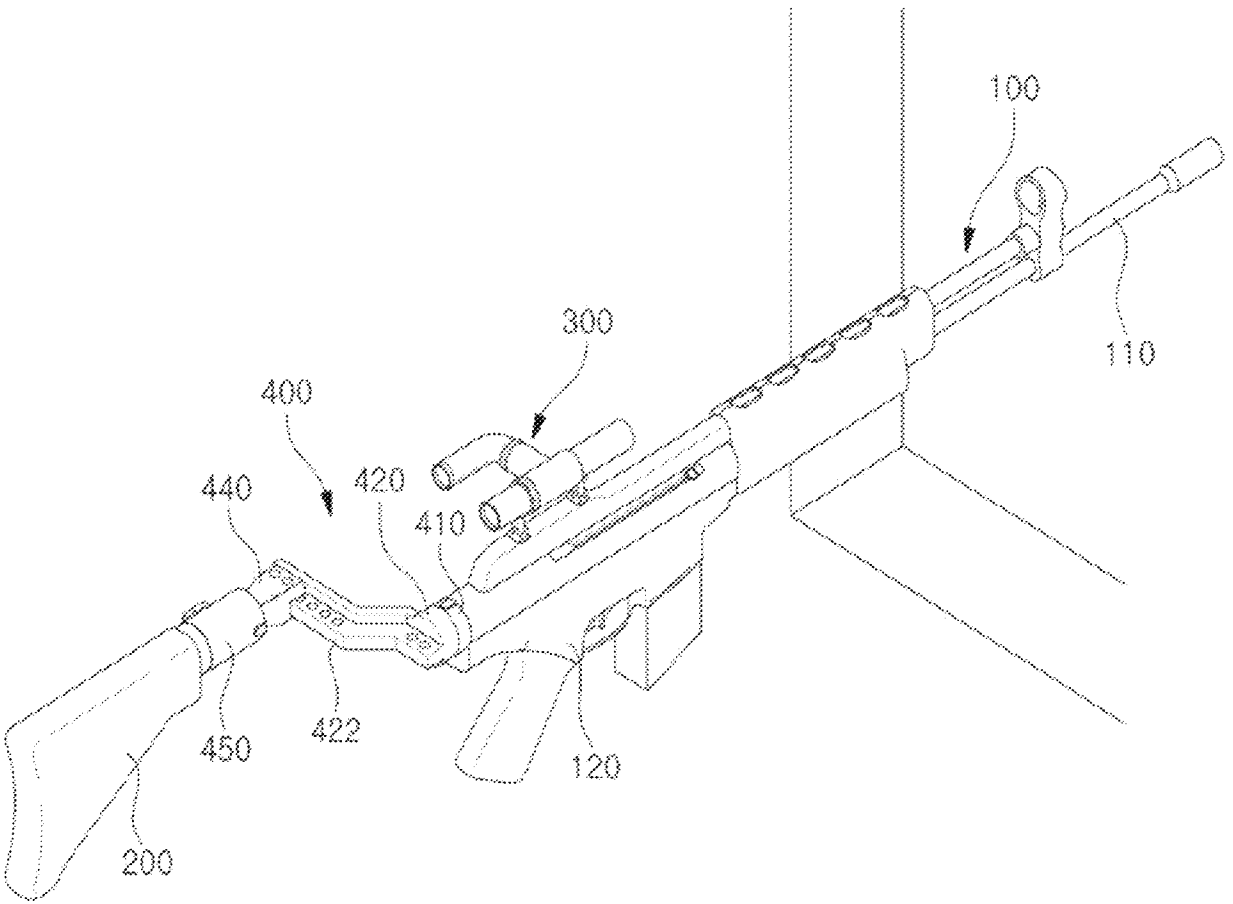
FIG. 9 is a perspective view showing a lateral fire mode of the firearm shown in FIG. 2.

Meanwhile, FIG. 9 shows a mode in which the user hides himself at one side of the shelter and fires at the target, i.e. a lateral fire mode in which the shoulder rest 200 is coupled to the firearm body 100 so as to be bent to one side.

To be more specific about the lateral fire mode, the first adaptor 420 is rotated such that the connecting bar 422 is horizontally located, and the shoulder rest 200 is located at one side of the firearm body 100.

In this way, when the connecting bar 422 is horizontally located, the shoulder rest 20) lies horizontally. For this reason, the second auxiliary adaptor 450 is rotated to vertically erect the shoulder rest 200 such that the shoulder rest is disposed so as to be able to be held against a shoulder of the user.

As described above, the present invention assumes an off-axis form in which the shoulder rest 200 is located in parallel to the gun barrel 110 of the firearm body 100 in any modes other than the ordinary fire mode. Therefore, since recoil generated in the event of the firing is transmitted directly backward to the shoulder rest 200 like the typical firearm, control over the recoil is easy.

Since the control over the recoil is easy in this way, the shoulder rest 200 can be stably correctly held against the shoulder of the user in the event of the firing.

As in the present embodiment, when the first adaptor 420 and the second adaptor 440 are configured to be connected to the firearm body 100 and the shoulder rest 200 by the first auxiliary adaptor 410 and the second auxiliary adaptor 450 respectively, there is an advantage that the shoulder rest 200 can be connected and assembled to a typical firearm in a bent state using the shoulder rest adaptor 400.

That is, the present invention can be carried out using the typical firearm without newly manufacturing the firearm body 100, and thus is economical.

Of course, if necessary, the first adaptor 420 and the second adaptor 440 may be directly connected to the firearm body 100 and the shoulder rest 200.

Figure 10:
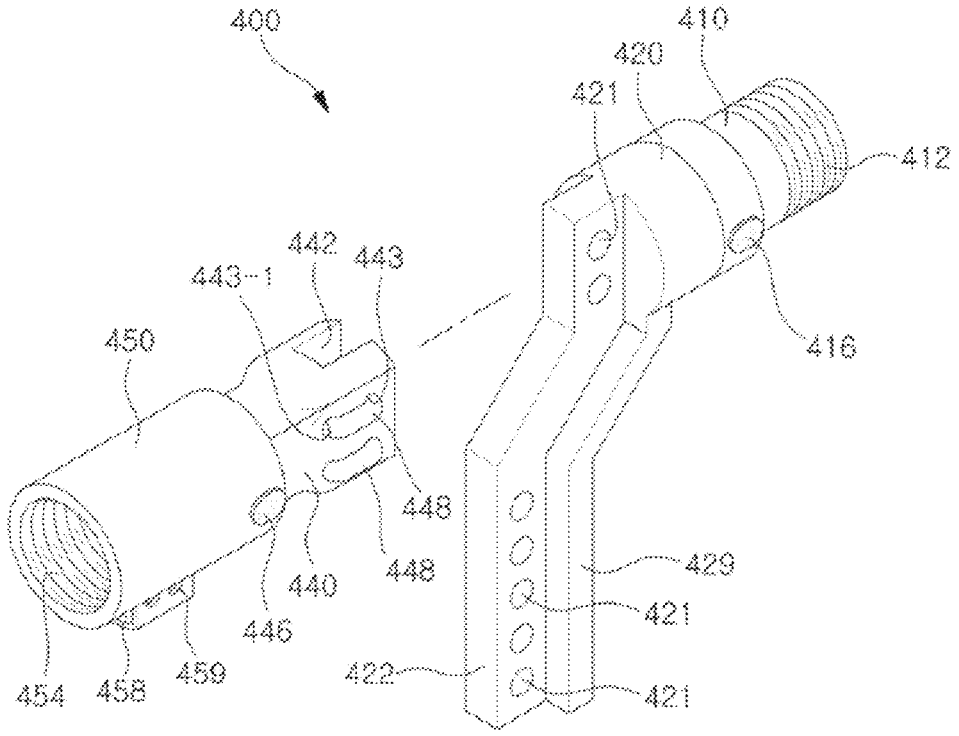
FIG. 10 is an exploded perspective view showing another embodiment of the shoulder rest adaptor according to the present invention.
Figure 11:
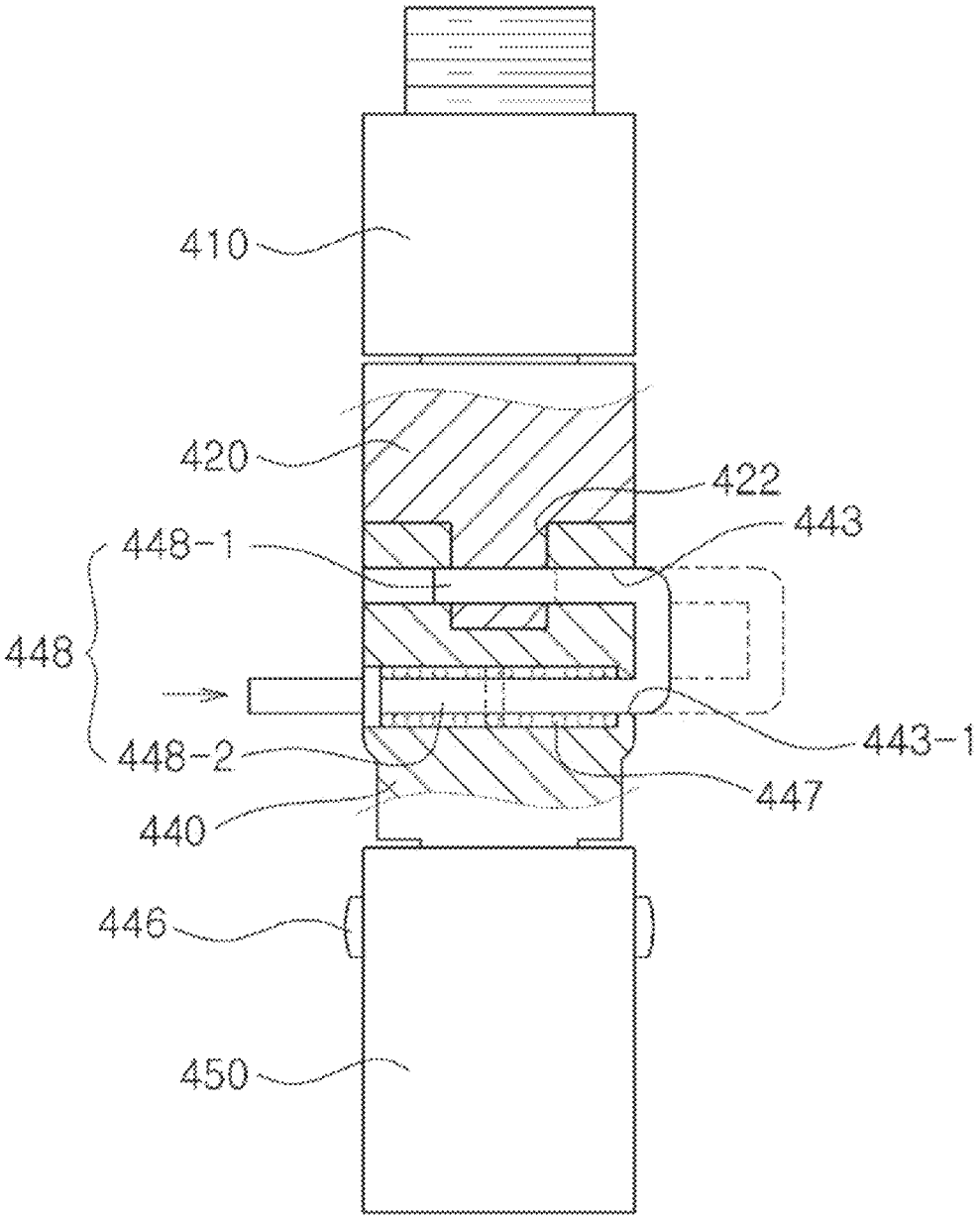
FIG. 11 is a top sectional view showing an assembly of FIG. 10.

FIGS. 10 and 11 show another embodiment of the present invention, and show a modification of the configuration for connecting the first adaptor 420 and the second adaptor 440.

As shown, auxiliary holes 443-1 are formed in the tear of the pin holes 443 of the second adaptor 440. Push bars 448 are fitted into the pin holes 443 and the auxiliary holes 443-1.

Each of the push bars 448 is made up of a key portion 448-1 that is inserted into each of the pin holes 443 and a push portion 448-2 that is connected to one end of the key portion 448-1 so as to be parallel with the key portion 448-1, and has a nearly U shape. The push portion 448-2 is formed to have a longer length than the auxiliary hole 443-1. When the push portion 448-2 is fitted into the auxiliary hole 443-1, a tip of the push portion 448-2 protrudes outside the auxiliary hole 443-1.

Meanwhile, a spring 447 is housed in the auxiliary hole 443-1 and elastically presses the push portion 448-2 such that the push portion 448-2 is maintained to be inserted in the auxiliary hole 443-1. The key portion 448-1 and the push portion 448-2 of the push bar 448 are maintained to be inserted in the pin hole 443 and the auxiliary hole 443-1 by the spring 447.

When the user intends to connect the first and second adaptors 420 and 440 using the push bars 448, the user presses the tips of the push portions 448-2 in a lateral direction to withdraw the key portions 448-1 from the insertion recess 442. Then, the user inserts the connecting bar 422 of the first adaptor 420 into the insertion recess 442 of the second adaptor 440, aligns the pin holes 421 of the first adaptor 420 and the pin holes 443 of the second adaptor 440 with each other, and removes a force pressing the push portions 448-2.

Thereby, the push bars 448 return to their initial state by means of the springs 447, and as shown in FIG. 11, the key portions 448-1 are inserted into the aligned pin holes 421 and 443 of the first and second adaptors 420 and 440. Therefore, the first and second adaptors 420 and 440 are connected.

In this way, in the present invention, since the push bars 448 are maintained to be coupled to the second adaptor 440, there is no risk of the push bars 448 being lost. Further, since the push bars 448 are displaced by a simple lateral pressing operation, there is an advantage that the first and second adaptors 420 and 440 are easily connected and assembled.

Meanwhile, as described above, to use the shoulder rest 200 in the various fire modes, a sight capable of aiming at the target according to each of the fire modes is required. Hereinafter, the sight 300 according to the present invention will be described.

Figure 12:
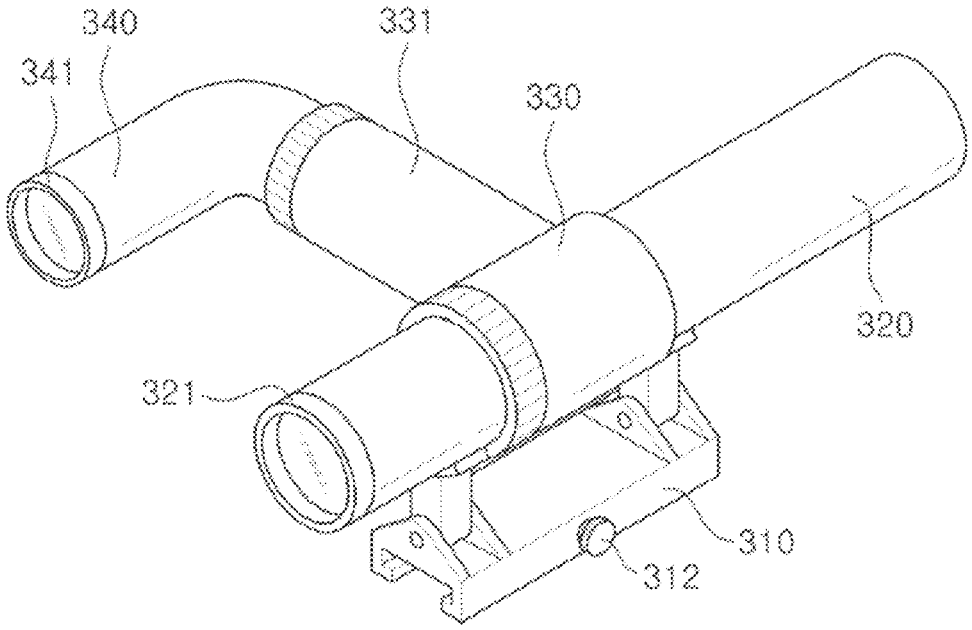
FIG. 12 is a perspective view of a sight according to an embodiment of the present invention.

FIG. 12 is a perspective view showing the sight 300 according to the present invention. As shown, the sight 300 includes a base 310 that is coupled to the firearm body 100, a main body tube 320 that is pivotably hinged to the base 310, a T-shaped connector 330 that is rotatably coupled to the main body tube 320 and has a branch tube 331 formed in a lateral direction, and an auxiliary body tube 340 that has an elbow shape and is coupled to the branch tube 331 of the T-shaped connector 330.

Figure 13:
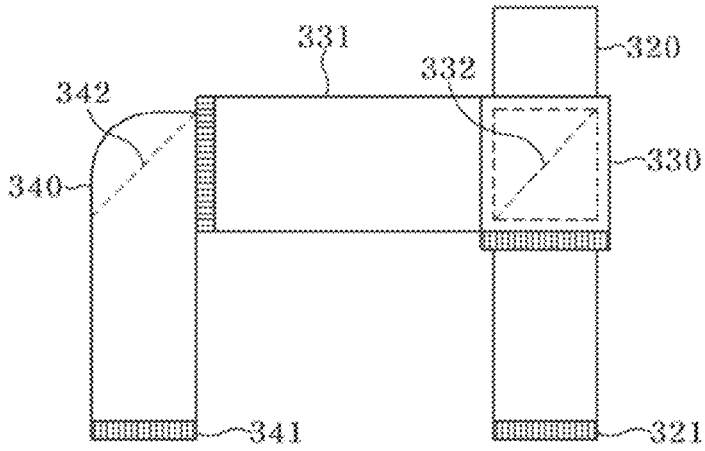
FIG. 13 is a top view of the sight according to the embodiment of the present invention.

FIG. 13 is a top view showing the sight 300 according to an embodiment of the present invention. As shown a prism 332 for reflecting incident light to the branch tube 331 of the T-shaped connector 330 at an angle of 90 degrees so as to travel straight is mounted in the main body tube 320, and a reflector 342 for reflecting the incident light to the rear at an angle of 90 degrees again is mounted in an elbow region of the auxiliary body tube 340. Therefore, the sight 300 has a configuration similar to that of a periscope.

Thus, both an eyepiece 341 of the auxiliary body tube 340 and an eyepiece 321 of the main body tube 320 are directed to the shoulder rest 200 in parallel to each other. That is, the main body tube 320 and the auxiliary body tube 340 are parallel to each other off the axis.

The sight 300 is configured such that the main body tube 320 thereof pivots to the left and right relative to the firearm body 100 and that the auxiliary body tube 340 thereof pivots relative to the main body tube 320 by means of the T-shaped connector 330.

A portion at which the main body tube 320 is hinged to the base 310 is provided with an angle adjusting means for adjusting a pivotal angle of the main body tube 320, and an angle adjusting means for adjusting a rotational angle of the T-shaped connector 330 is provided between the main body tube 320 and the T-shaped connector 330. These angle adjusting means may be implemented by employing the configuration using the leaf spring or the latch ball as described above in the shoulder rest adaptor 400, and detailed descriptions thereof will be omitted.

Meanwhile, the auxiliary body tube 340 is slidably coupled to the T-shaped connector 330. An interval between the auxiliary body tube 340 and the main body tube 320 is adjusted. If necessary, the branch tube 331 of the T-shaped connector 330 is telescopically configured so that the interval between the auxiliary body tube 340 and the main body tube 320 can be adjusted.

A reference numeral 312 that is not described indicates a coupling screw for detachably coupling the sight 300 to the firearm body 100. The base 310 of the sight 30 is slidably coupled to the firearm body 100 so as to be slidable backward or forward.

In the sight 300 having this configuration, the position of the auxiliary body tube 340 is adjusted to the left and right relative to the main body tube 320 according to the position of the shoulder rest 200, and the interval between the auxiliary body tube 340 and the main body tube 320 is adjusted according to a distance by which the shoulder rest 200 is bent from the firearm body 100.

Figure 14:
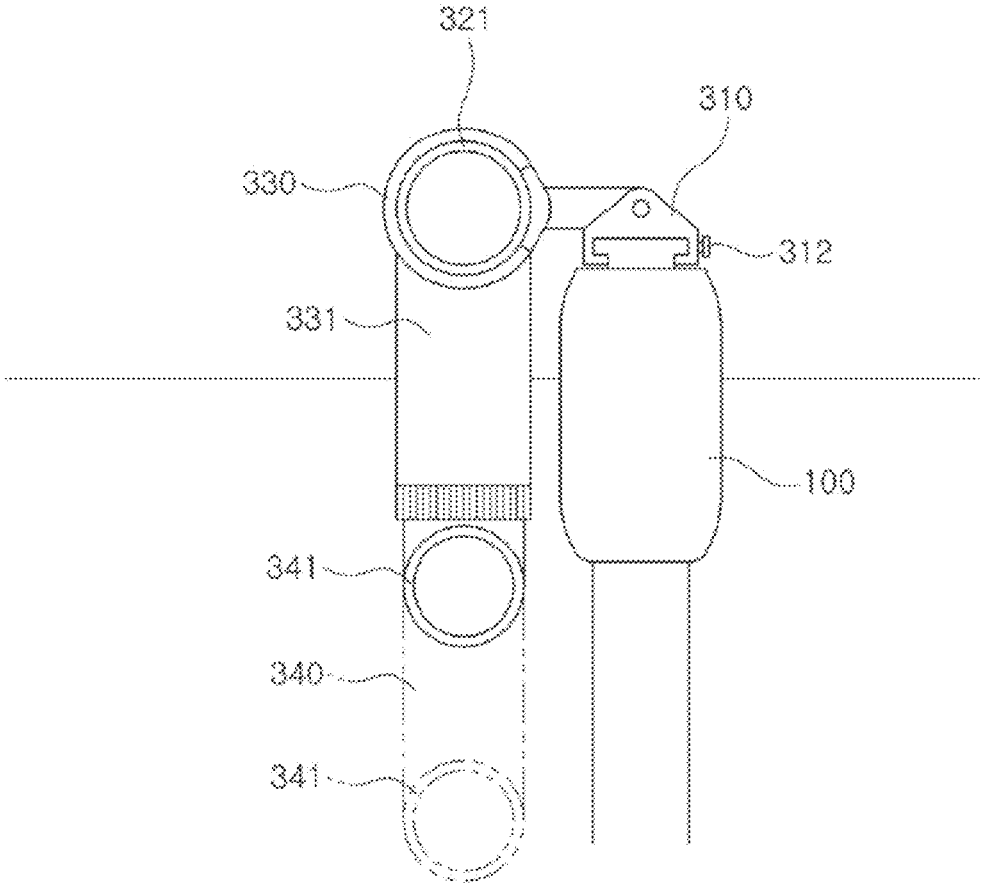
FIG. 14 is a rear view showing an upper fire mode of the sight shown in FIG. 12.
Figure 15:
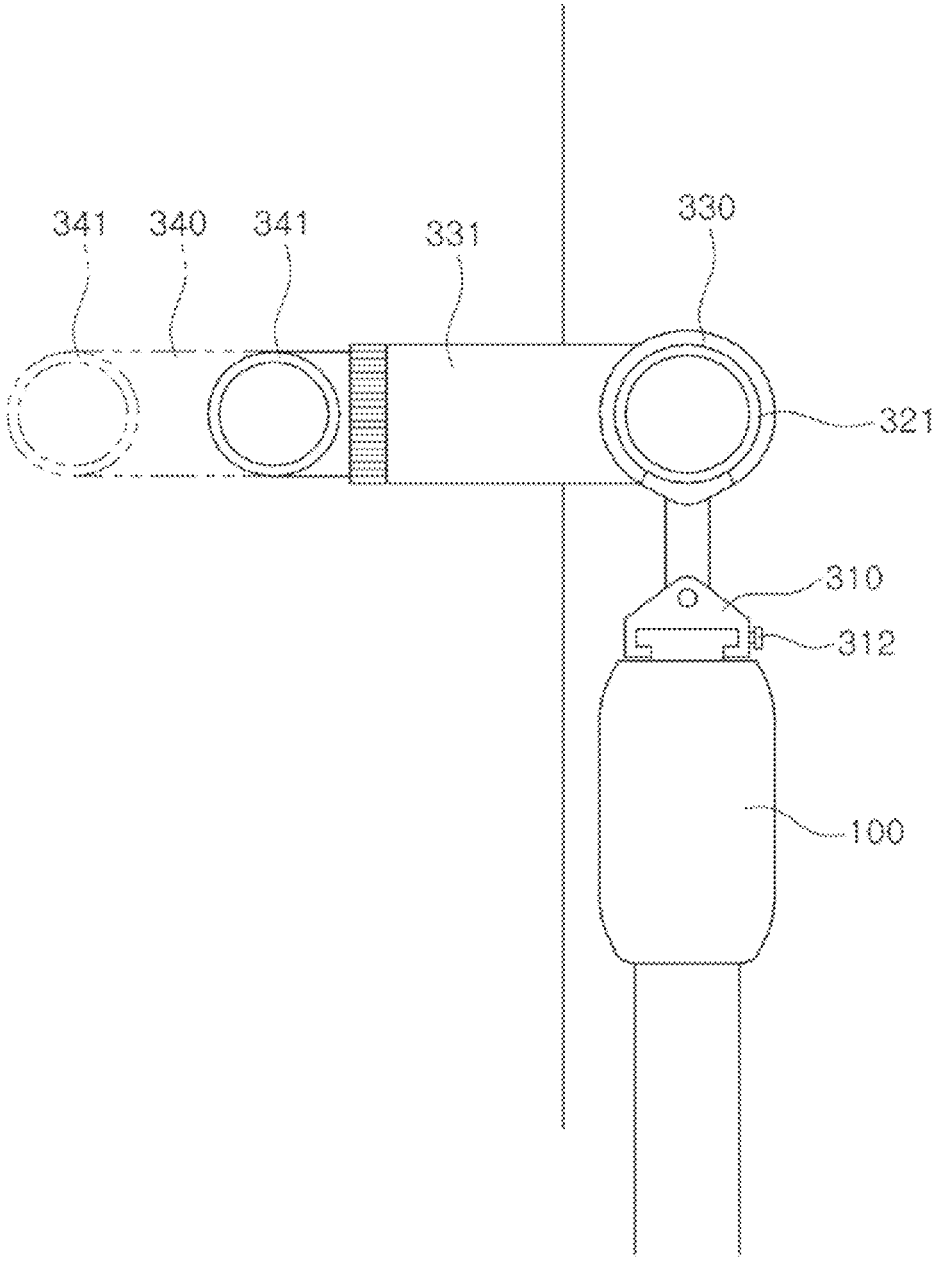
FIG. 15 is a rear view showing a lateral fire mode of the sight shown in FIG. 12

FIG. 14 shows an adjusted form of the sight 300 in the upper fire mode as in FIG. 8. FIG. 15 shows an adjusted form of the sight 300 in the lateral fire mode as in FIG. 9.

As described above, the sight 301 according to the present invention provides easy aiming because the eyepieces 321 and 341 of the main and auxiliary body tubes 320 and 340 are directed in parallel to the shoulder rest 200. Further, the aiming is possible using the main body tube 320 in the ordinary fire mode, and using the auxiliary body tube 340 in the other fire modes. Thus, there is an advantage that a single sight can be used in the various fire modes.

In addition, since the sight 300 is configured in a periscope type, the gun barrel 110 of the firearm is parallel with the eyepieces 321 and 341 of the sight 300. Therefore, the aiming is possible without left-right reflection (reversal) of light generated when a conventional aiming device such as an angle sight or an off-axis viewing device for aiming at 45 degrees is used.

Figure 16:
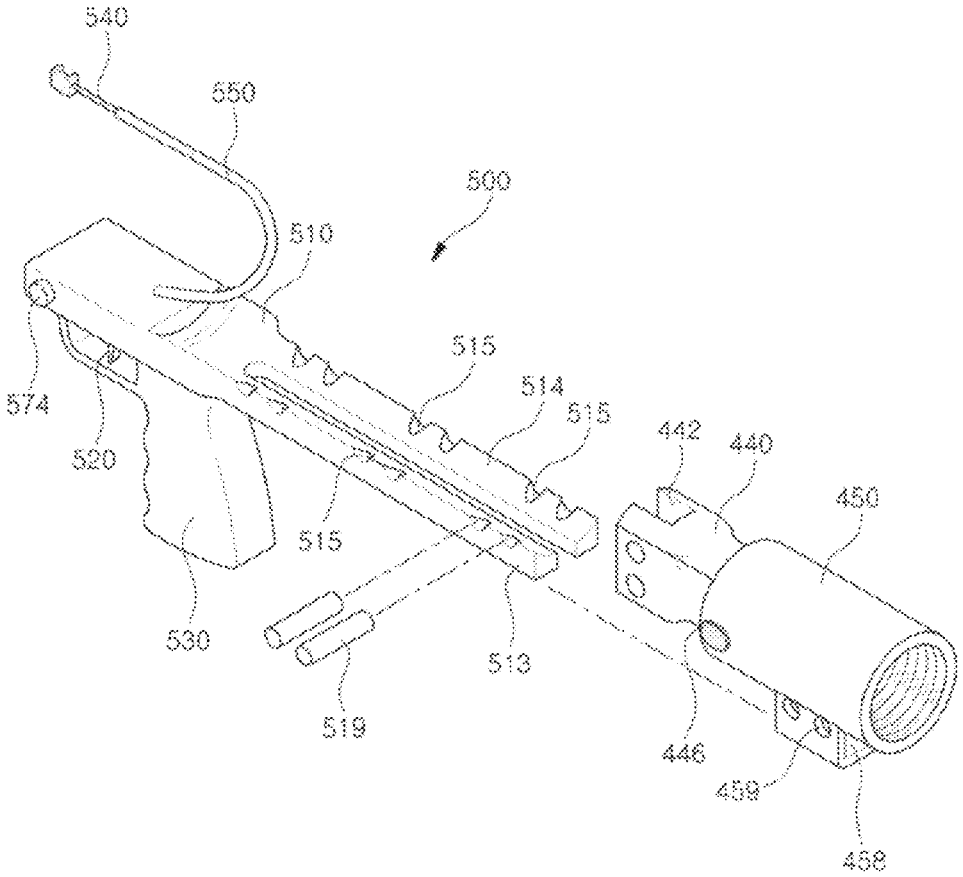
FIG. 16 is a perspective view of an auxiliary percussion device according to an embodiment of the present invention.
Figure 17:
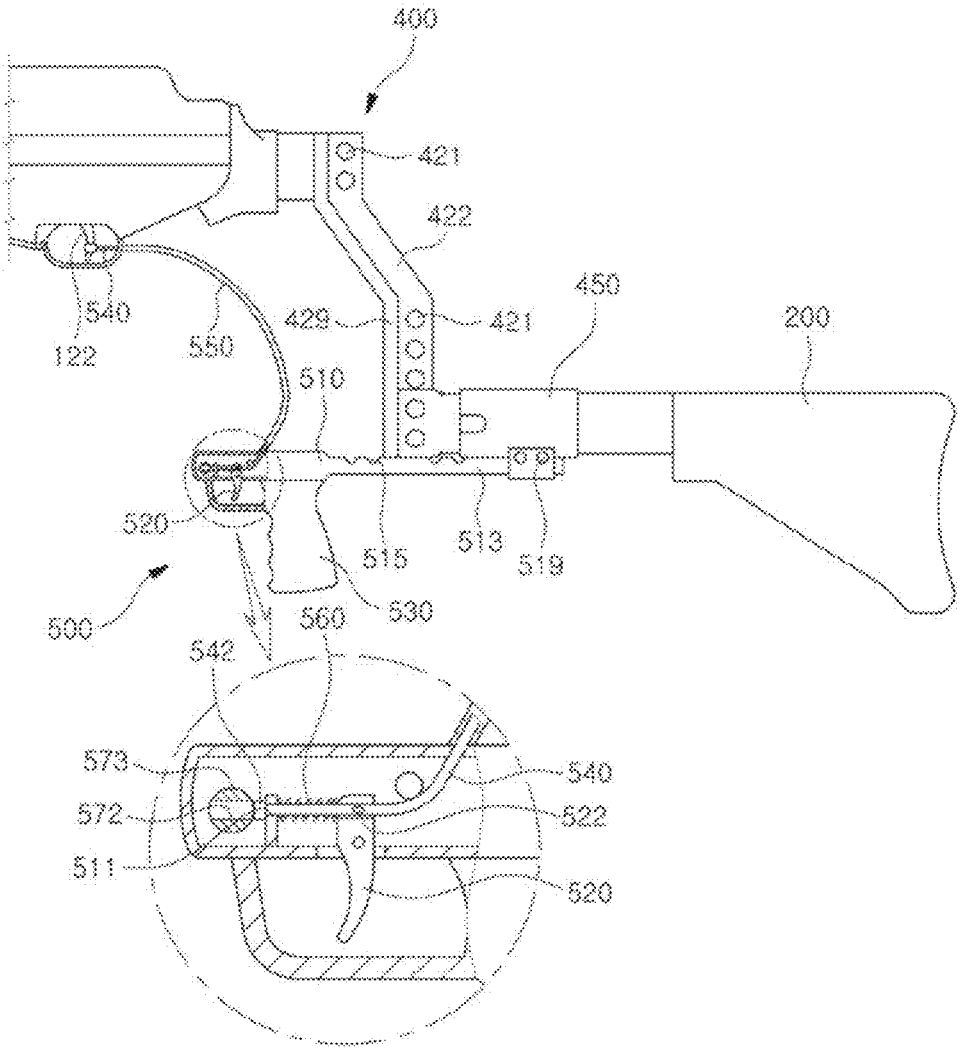
FIG. 17 is a partial side sectional view showing a state in which the auxiliary percussion device shown in FIG. 16 is mounted.
Figure 18:
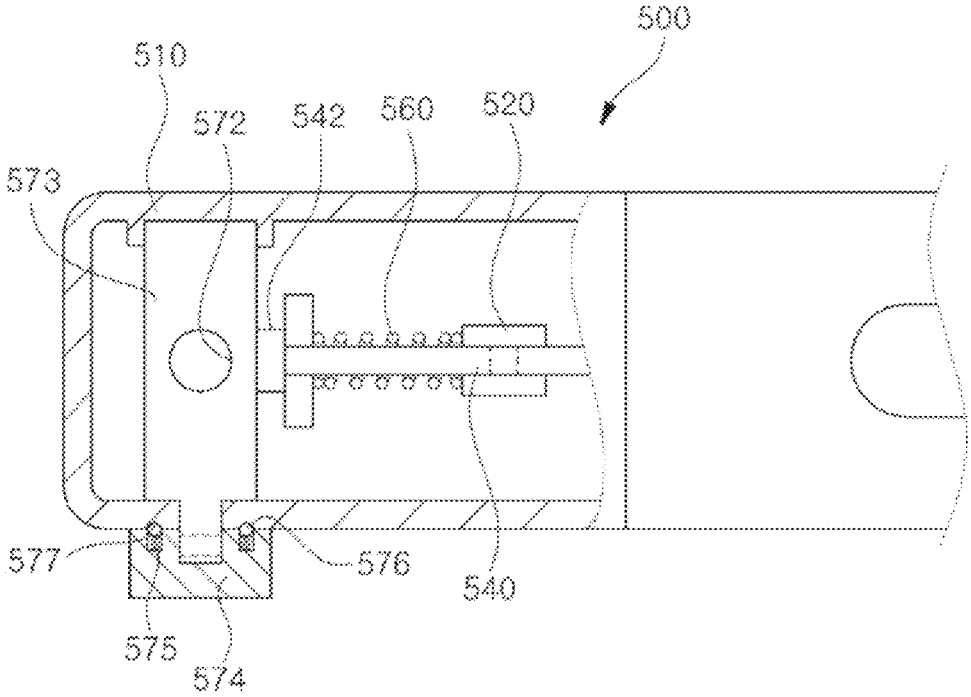
FIG. 18 is a partial top sectional view showing the auxiliary percussion device shown in FIG. 16.

FIGS. 16 to 18 show another embodiment of the present invention, and show an auxiliary percussion device 500 that is additionally provided for the present invention.

The auxiliary percussion device 500 includes an auxiliary percussion body 510, an auxiliary trigger 520 that is provided at a lower side of a front end of the auxiliary percussion body 510, an auxiliary grip 530 that is provided under the auxiliary percussion body 510 so as to be located at the rear of the auxiliary trigger 520, a connecting cable 540 that connects the auxiliary trigger 520 to a trigger 122 formed at the percussion mechanism 120 of the firearm body 100, and a return spring 560 that returns the auxiliary trigger 520 to its initial state. The connecting cable 540) is housed in a separate cable case 550, and is connected to the trigger 122 and the auxiliary trigger 520.

A pair of slide bars 513 and 514 are formed in parallel at a rear end of the auxiliary percussion body 510 so as to be laterally spaced apart from each other. The slide bars 513 and 514 are coupled to a second auxiliary adaptor 450 of the shoulder rest adaptor 400. Upper surfaces of the slide bars 513 and 514 are formed with numerous pairs of hemispherical pin holes 515 spaced apart from each other across the slide bars 513 and 514.

Meanwhile, a pair of slide holes 458 to which the slide bars 513 and 514 are slidably coupled are formed at a lower side of the second auxiliary adaptor 450, and a pair of pin holes 459 are formed across the slide holes 458.

Therefore, when a user fits the slide bars 513 and 514 into the slide holes 458, aligns the pin holes 515 and 459, and inserts fixing pins 519) into the pin holes 515 and 459, the auxiliary percussion body 510 of the auxiliary percussion device 500 is coupled to the second auxiliary adaptor 450. The auxiliary percussion body 510 slides forward or backward according to a posture of the user, thereby adjusting a position of the auxiliary trigger 520 to a position suitable for percussion.

In this way, the auxiliary percussion body 510 is coupled to the second auxiliary adaptor 450 so that the auxiliary percussion body 510 is bent relative to the firearm body 100 along with the shoulder rest 200. Moreover, since the auxiliary trigger 520 and the trigger 122 of the firearm body 100 are connected by the connecting cable 540, a position of the auxiliary percussion device 500 is freely changed depending on the bending of the shoulder rest 200.

Meanwhile, the trigger 122 provided for the percussion mechanism 120 of the firearm body 100 moves together with the auxiliary trigger 520 by means of the connecting cable 540. A connecting relation between the auxiliary trigger 520 and the trigger 122 provided for the firearm body 100 will be described below in greater detail with reference to FIG. 16.

The auxiliary trigger 520 is configured such that nearly the middle thereof is hinged to the auxiliary percussion body 510. An upper end of the auxiliary trigger 520 is provided with a connecting pin 522 passing through the connecting cable 540.

One end of the connecting cable 540 is connected to the trigger 122 of the firearm body 100. The other end of the connecting cable 540 is guided into the auxiliary percussion body 510, and is connected to the auxiliary trigger 520. The connecting pin 522 of the auxiliary trigger 520 passes through the connecting cable 540.

The other end of the connecting cable 540 connected to the auxiliary trigger 520 is slidably fitted into a through-hole 511 formed in the auxiliary percussion body 510. A reference numeral 542 that is not described indicates a stopper that catches the connecting cable 540 to prevent the connecting cable 540 from escaping from the through-hole 511 in a backward direction.

The return spring 560 is interposed between the through-hole 511 and the auxiliary trigger 520 so as to press the upper end of the auxiliary trigger 520 in a backward direction to enable repetitive operation.

As the connecting cable 540 is connected in this way, when the auxiliary trigger 520 is pulled, the upper end of the auxiliary trigger 520 pivots forward, and the connecting cable 540 is pulled forward.

When the connecting cable 540 is pulled forward, the trigger 122 of the firearm body 100 is pulled backward, and the percussion mechanism 120 of the firearm body 100 is operated. A ball cartridge is fired. The auxiliary trigger 520 returns to its initial state by means of the return spring 560.

The cable case 550 in which the connecting cable 540 is housed prevents the connecting cable 540 from arbitrarily moving, and assists the smooth operation of the trigger 122 of the firearm body 100 when the auxiliary trigger 520 is operated. Preferably, the cable case 550 is formed of a material having flexibility enough to be bent by the operation of the user.

Meanwhile, the auxiliary percussion device 500 is equipped with a safety lock. The safety lock is to prevent the auxiliary percussion device 500 from being operated in an unintended situation through carelessness of the user.

Of course, the percussion mechanism 120 of the firearm body 100 is equipped with a safety lock. However, if the safety lock is provided for the auxiliary percussion device 500, a dual safety lock is provided, and thus safety is more enhanced.

The safety lock of the auxiliary percussion device 500 will be described below in detail with reference to FIGS. 15 and 18. The safety lock according to the present invention includes a rotary shaft 573 that is mounted in and across the auxiliary percussion body 510, and a safety lever 574 that is connected to the rotary shaft 573 outside the auxiliary percussion body 510 and rotates the rotary shaft 573.

The rotary shaft 573 is located to cross the other end of the connecting cable 540, i.e. the front of the stopper 542. The rotary shaft 573 is formed with a through-hole 572 through which the other end of the connecting cable 540 to which the stopper 542 is coupled passes.

As shown in FIG. 17, when the though-hole 572 of the rotary shaft 573 is located in a horizontal direction, the through-hole 572 and the stopper 542 of the connecting cable 540 are aligned forward and backward Thus, when the auxiliary trigger 520 is pulled in this state, the connecting cable 540 passes the through-hole 572 to move forward, and thus the auxiliary percussion device 500 is operated without interfering with the rotary shaft 573.

However, as shown in FIG. 18, when the rotary shaft 573 is rotated and the through-hole 572 is located vertically, the stopper 542 of the connecting cable 540 is caught on the rotary shaft 573 and does not move forward. As a result, the operation of the auxiliary trigger 520 is controlled.

Meanwhile, latch balls 576 for controlling rotation of the safety lever 574 are mounted on an inner surface of the safety lever 574. The latch balls 576 are elastically biased outward by springs 575, and are provided in a pair so as to be symmetrical on the left and right or on the top and bottom with respect to the center of the safety lever 574.

Also, latch grooves 577 into or from which the latch balls 576 are inserted or separated are formed in an outer surface of the auxiliary percussion body 510 at intervals of 90 degrees on the left, right or top and bottom.

Therefore, when the safety lever 574 is rotated, the latch balls 576 are caught on the latch grooves 577, and the rotated state of the safety lever 574 is fixed. Thus, the rotation of the safety lever 574 is controlled.

Before the firing, the user rotates the safety lever 574 to release the safety lock such that the through-hole 572 of the rotary shaft 573 is located to be aligned with the other end of the connecting cable 540. Where there is no firing, the user rotates the safety lever 574 to lock the safety lock such that the through-hole 572 of the rotary shaft 573 is located in an upward/downward direction.

The configuration of the safety lock is not naturally limited to the configuration described in the present embodiment. Of course, various configurations may be employed, for instance be configured to directly control the operation of the auxiliary trigger 520.

The auxiliary percussion device 500 having the configuration as described above is connected to the second auxiliary adaptor 450 of the shoulder rest adaptor 400, and is positioned along with the shoulder rest 200. Moreover, since the auxiliary trigger 520 of the auxiliary percussion device 500 and the trigger 122 of the firearm body 100 are connected by the connecting cable 540, the position of the auxiliary percussion device 500 is easily changed.

Thus, there is an advantage that the auxiliary percussion device 500 according to the present invention can be used in any fire mode.

When the auxiliary percussion device 500 is mounted on the firearm body 100 for use, it is possible to avoid exposure of hands and arms grasping the firearm, and a danger of an injury is remarkably reduced. In addition, there is an advantage that can open fire in a comfortable and correct posture.

Figure 19:
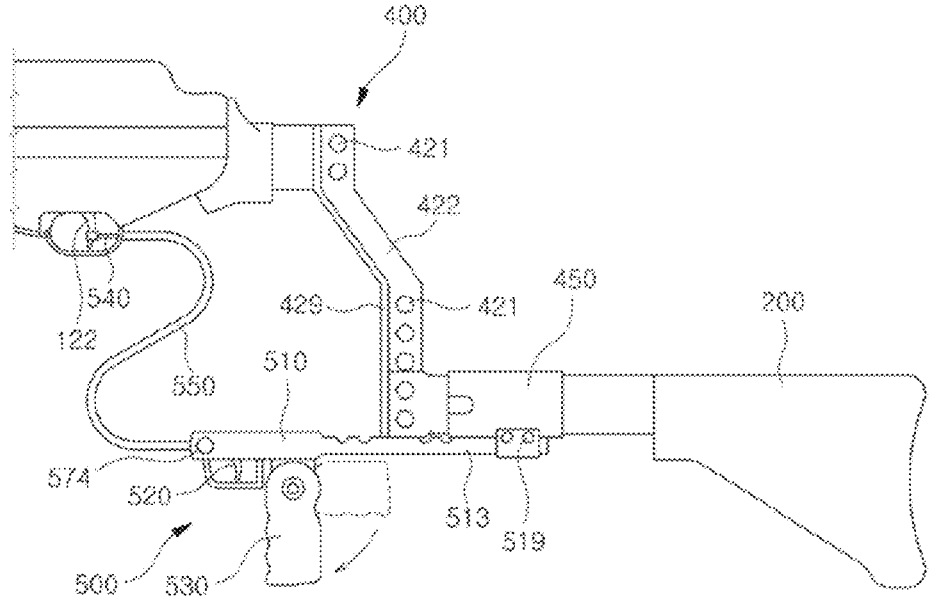
FIG. 19 is a side view showing another embodiment of the auxiliary percussion device according to the present invention.

FIG. 19 shows that the auxiliary grip 530 of the auxiliary percussion device 500 is configured to be pivotably folded. If the auxiliary grip 530 is configured to be pivotally folded, there is an advantage that the auxiliary percussion device 500 has a compact shape and thus occupies a less space.

The invention claimed is:

1. A bendable firearm having an off-axis shoulder rest and sight, comprising:

a firearm body (100) having a gun barrel (110) and a percussion mechanism (120) configured to fire a ball cartridge through the gun barrel (110);

a shoulder rest (200) provided at a rear end of the firearm body (100); and a sight (300) coupled to the firearm body (100), wherein the shoulder rest (200) is bendably coupled to the firearm body (100) by a separate shoulder rest adapter (400), the shoulder rest adaptor (400) includes a first adaptor (420), a front end of which is directly or indirectly rotatably connected to the firearm body (100) and at a rear end of which, a connecting bar (422) is formed to protrude to one side, and a second adaptor (440), a front end of which is detachably coupled to the connecting bar (422) of the first adaptor (420) and a rear end of which is directly or indirectly rotatably connected to the shoulder rest (200).

2. The bendable firearm according to claim 1, wherein:

the first adaptor (420) is rotatably coupled to a rear end of a first auxiliary adaptor (410) screwed into the firearm body (100) so as to be connected to the firearm body (100) by the first auxiliary adaptor (410);

an angle adjusting means for adjusting rotational angle of the first adaptor (420) is provided between the first adaptor (420) and the first auxiliary adaptor (410).

3. The bendable firearm according to claim 2, wherein:

a plurality of pin boles (421) are formed in the connecting bar (422) in a longitudinal direction;

an insertion recess (442) into which the connecting bar (422) is inserted in a width direction and a pair of upper and lower pin holes (443) configured to cross the insertion recess (442) are formed at the front end of the second adaptor (440); and the second adaptor (440) and the connecting bar (422) are detachably coupled by fixing pins (449) inserted into aligned pin holes (421, 443) of the connecting bar (422) and the second adaptor (440).

4. The bendable firearm according to claim 2, wherein:

a plurality of pin holes (421) are formed in the connecting bar (422) in a longitudinal direction;

an insertion recess (442) into which the connecting bar (422) is inserted in a width direction, a pair of upper and lower pin holes (443) configured to cross the insertion recess (442), and a pair of auxiliary holes (443-1) located back of the pin holes (443) so as to be parallel with the pin holes (443) are formed at the front end of the second adaptor (440);

push bars (448), which are made up of push portions (448-2) that are connected to one ends of key portions (448-1) and are inserted into the auxiliary holes (443-1) such that front ends thereof are exposed to outside of the auxiliary holes (443-1), are elastically installed on the second adaptor (440) by springs (470); and the key portions (448-1) are inserted into the aligned pin holes (421, 443) of the connecting bar (422) and the second adaptor (440), and the second adaptor (440) and the connecting bar (422) are detachably coupled by fixing pins (449).

5. The bendable firearm according to claim 1, wherein the sight (300) includes:

a base (310) that is detachably coupled to the firearm body (100);

a main body tube (320) that is coupled to the base (310);

a T-shaped connector (330) that is formed with a branch tube (331), has a T shape, and is coupled to the main body tube (320); and an auxiliary body tube (340) that has an elbow shape and is coupled to the branch tube (331) of the T-shaped connector (330).

6. The bendable firearm according to claim 5, wherein the main body tube (320) is pivotably coupled to the base (310), the T-shaped connector (330) is rotatably coupled to the main body tube (320), and angle adjusting means for adjusting pivotal and rotational angles are provided between the main body tube (320) and the base (310) and between the main body tube (320) and the T-shaped connector (330).

7. The bendable firearm according to claim 5, wherein a prism (332) for reflecting incident light to the branch tube (331) of the T-shaped connector (330) at an angle of 90 degrees so as to travel straight is mounted in the main body tube (320), and a reflector (342) for reflecting the incident light to the rear at an angle of 90 degrees again is mounted in an elbow region of the auxiliary body tube (340).

8. The bendable firearm according to claim 5, wherein the branch tube (331) or an end connected to the branch tube (331) of the auxiliary body tube (340) is telescopically formed to be able to adjust a distance between the auxiliary body tube (340) and the main body tube (320).

9. The bendable firearm according to claim 1, further comprising an auxiliary percussion device (500), wherein the auxiliary percussion device (500) includes:

an auxiliary percussion body (510). a. rear end of which is coupled to the second adaptor (440);

an auxiliary trigger (520) that is mounted on the auxiliary percussion body (510);

an auxiliary grip (530) that is mounted on the auxiliary percussion body (510) so as to be located back of the auxiliary trigger (520);

a connecting cable (540), one end of which is connected to the auxiliary trigger (520) and the other end of which is connected to a trigger (122) provided for the percussion mechanism (200) of the firearm body (100); and a return spring (560) that is coupled to the connecting cable (540) and returns the auxiliary trigger (520) to a state before operation, and when the auxiliary trigger (520) is operated, the trigger (122) of the percussion mechanism (120) is operated together with the auxiliary trigger (520) such that a ball cartridge is fired by the percussion mechanism (120).

10. The bendable firearm according to claim 9, wherein the connecting cable (540) is inserted in a cable case (550).

11. The bendable firearm according to claim 9, wherein:

a second auxiliary adaptor (450) is interposed between the second adaptor (440) and the shoulder rest (200);

slide holes (458) penetrated in a forward/backward direction are formed at a lower side of the second auxiliary adaptor (450); and a rear end of the auxiliary percussion body (510) is slidably fitted into the slide holes (458) so as to be able to adjust a front/rear position of the auxiliary percussion device (500).

12. The bendable firearm according to claim 9, wherein an upper end of the auxiliary grip (530) is pivotably coupled to the auxiliary percussion body (510).

* * * * *